US005098092A

United States Patent [19]

Aakre et al.

[11] Patent Number: 5,098,092

[45] Date of Patent: Mar. 24, 1992

[54] PORTABLE FOLDABLE BASKETBALL BACKBOARD ASSEMBLY

[76] Inventors: Stewart C. Aakre, R.R. 3, Hawley, Minn. 56549; William A. Fulcher, P.O. Box 657, Sandia Park, N. Mex. 87047; Gary L. Johnson, 3609 Singapore Cir., NE., Albuquerque, N. Mex. 87111

[21] Appl. No.: 556,849

[22] Filed: Jul. 20, 1990

Related U.S. Application Data

[63] Continuation-in-part of Ser. No. 336,202, Apr. 10, 1989, Pat. No. 4,946,163.

[51] Int. Cl.[5] ..... A63B 63/08

[52] U.S. Cl. ..... 273/1.5 R

[58] Field of Search ..... 273/1.5 R, 1.5 A, 411; 248/462, 166, 463, 465, 129, 150, 136

[56] References Cited

U.S. PATENT DOCUMENTS

| | | | |
|---|---|---|---|
| 3,288,413 | 11/1966 | Gregory | 273/411 X |
| 3,329,427 | 7/1967 | Bearson | 273/1.5 R |
| 3,341,197 | 9/1969 | Bottorff | 273/1.5 R |
| 3,427,025 | 2/1969 | Proctor | 273/1.5 R |
| 3,598,407 | 8/1971 | Sorensen | 273/1.5 R |
| 3,614,099 | 10/1971 | Sarno | 273/1.5 R |
| 3,650,530 | 3/1972 | Gantz | 273/1.5 R X |
| 3,722,886 | 3/1973 | Sinner | 273/1.5 R |
| 4,526,367 | 7/1985 | Haston et al. | 273/1.5 R |
| 4,869,501 | 9/1989 | Anastasakis | 273/1.5 R |

FOREIGN PATENT DOCUMENTS

| | | | |
|---|---|---|---|
| 620505 | 5/1961 | Canada | 273/1.5 R |
| 2234942 | 2/1973 | Fed. Rep. of Germany | 273/1.5 R |
| 2525998 | 12/1976 | Fed. Rep. of Germany | 273/1.5 R |
| 306083 | 6/1955 | Switzerland | 273/1.5 R |

*Primary Examiner*—Paul E. Shapiro
*Attorney, Agent, or Firm*—William A. Eklund

[57] ABSTRACT

A portable, foldable basketball backboard assembly. In an upright deployed position the assembly is erected to provide a regulation size basketball backboard. The assembly may be folded downwardly into a compact, folded assembly that is sufficiently compact in size and short in height to permit it to be transported and stored in ordinary storage facilities. In the folded position the assembly is transportable on integral caster wheel assemblies. The assembly is raised and lowered by a lift mechanism which facilitates raising of the assembly while also preventing the assembly from being lowered suddenly or unexpectedly. An extendible goal post, which supports a foldable backboard and a hoop, extends upwardly and outwardly from the base so as to provide a clear playing space beneath the backboard.

19 Claims, 7 Drawing Sheets

PORTABLE FOLDABLE BASKETBALL BACKBOARD ASSEMBLY

This is a continuation-in-part of copending application Ser. No. 07/336,202, filed on April 10, 1989, U.S. Pat. No. 4,946,163.

BACKGROUND OF THE INVENTION

1. Field of the Invention

The present invention is generally related to basketball backboards, goals and supporting structures. More particularly, the present invention is related to foldable and transportable basketball backboards.

2. Related Art

Conventional basketball backboards are typically mounted on a fixed pole or other stationary object. The vibration and impact to which a basketball backboard is subjected ordinarily mandates that a pole on which the backboard is mounted be securely set in concrete. The cost and difficulty of setting a pole in concrete is sufficiently great to deter many casual basketball players from installing a backboard. Moreover, permanently installed backboards are inappropriate for some locations that would otherwise be suitable for playing basketball, or are inconsistent with other uses occasionally required of some locations.

A number of portable basketball backboards have been previously available. Such backboards are typically mounted on wheeled frames or similar devices, so that the backboard can be wheeled from one place to another. Although such portable backboards can indeed be moved from one location to another, they are generally large and unwieldy, and because of their considerable height are not easily stored or transported more than a short distance without considerable difficulty.

In gymnasiums, basketball backboards are commonly suspended from the ceiling on a permanent swingable structure which permits the backboard to be positioned at its ordinary height and playing position when desired, yet which also allows the backboard to be swung upwardly out of the way to permit the gymnasium to be used for other activities with which a conventional fixed basketball backboard would interfere. Although this approach is suitable for a gymnasium, it does not meet the needs of the casual basketball player who might wish to occasionally play basketball at other locations.

Accordingly, the object and purpose of the present invention is to provide a portable and collapsible basketball backboard which can be temporarily installed at any desired location, and which can be compactly folded for ease of both transportation and storage.

It is another object of the present invention to provide a portable, foldable basketball backboard assembly which can be easily transported, and which can also be stored in modestly sized storage spaces.

SUMMARY OF THE INVENTION

In accordance with the present invention, there is provided a portable, foldable basketball backboard assembly. The assembly includes a generally flat base having front and rear ends. The assembly includes at least one lower support arm which is hinged to the front end of the base, and at least one upper support arm which is hinged to the upper end of the lower support arm. The upper end of the upper support arm is hinged to an intermediate point on an elongate extendible goal post which has an upper end and a lower end. The goal post supports a basketball backboard and hoop at its upper end, with the lower end of the goal post being pivotably connected to the rear end of the base.

The assembly preferably includes a mechanical lift means for manually raising the upper and lower support arms upwardly into alignment, so as to thereby raise and support the extendible goal post and the basketball backboard and hoop at a height suitable for playing basketball. The assembly further includes a plurality of rearwardly extending caster wheel assemblies, onto which the assembly may be tipped, with the goal post being lowered and retracted, into a compact, folded, lowered configuration that is suitable for transport and storage of said assembly.

In the preferred embodiment, the assembly includes two lower support arms and two upper support arms, with the lower ends of the lower support arms being hinged to opposite sides of the front end of the base. The preferred embodiment further includes an upright support post that extends upwardly from the rear end of the base, with the lower end of the goal post being hinged to the support post.

The extendible goal post preferably consists of a tubular extension tube which is hinged at its lower end to the upright support post, and a telescoping, retractible goal post that is slidably contained within and extends from the extension tube. There is further included an extension mechanism for selectively extending the goal post from, or withdrawing the goal post into, the extension tube. The extension mechanism preferably includes a threaded shaft contained within the extension tube, with the goal post including a threaded end cap that is engaged with the threaded shaft. A goal post extension crankshaft is provided for selectively turning the threaded shaft for extending or withdrawing the goal post.

The goal post extension crankshaft is connected to the threaded shaft by a pair of cooperable spider gears which are affixed to the crankshaft and to the threaded shaft, respectively. The crankshaft may preferably be journalled in the upright support post so as also function as the hinge for the extension tube.

In the preferred embodiment there is affixed to the upper end of the upright support post a first rearwardly extending caster wheel, and there are second and third rearwardly extending caster wheels affixed to opposite sides of the rear end of the base. This arrangement permits the entire assembly to be tilted upwardly onto the three caster wheels for transport and storage. Since the goal post can be retracted and folded downwardly in preparation for transport and storage, the folded assembly is compact and low enough to be stored in ordinary storage places.

The basketball backboard is preferably hinged to the goal post, and the basketball hoop is in turn hinged to the backboard, such that the hoop and the backboard may be folded backward over the goal post upon folding of the assembly for storage.

The lift mechanism for raising the upper and lower support arms upwardly into alignment preferably includes a lift arm, a threaded drive shaft journalled to the base and extending rearwardly from and beneath the lower support arms, and a lift arm crankshaft. The lift arm has an upper end hinged to the lower support arms, and a lower end hinged to a threaded drive block engaged with the drive shaft. The crankshaft is operably engaged with the drive shaft. Rotation of the crankshaft results in rotation of the drive shaft, which in turn drives the lower end of the lift arm along the drive shaft so as to raise or lower the lower support arms as well as the extendible goal post.

These and other aspects of the present invention will be more apparent from the accompanying drawings and the following detailed description of the invention.

BRIEF DESCRIPTION OF THE DRAWINGS

The accompanying drawings form a part of and are incorporated into this specification. In the drawings.

DETAILED DESCRIPTION OF THE PREFERRED EMBODIMENT

Figure 1:
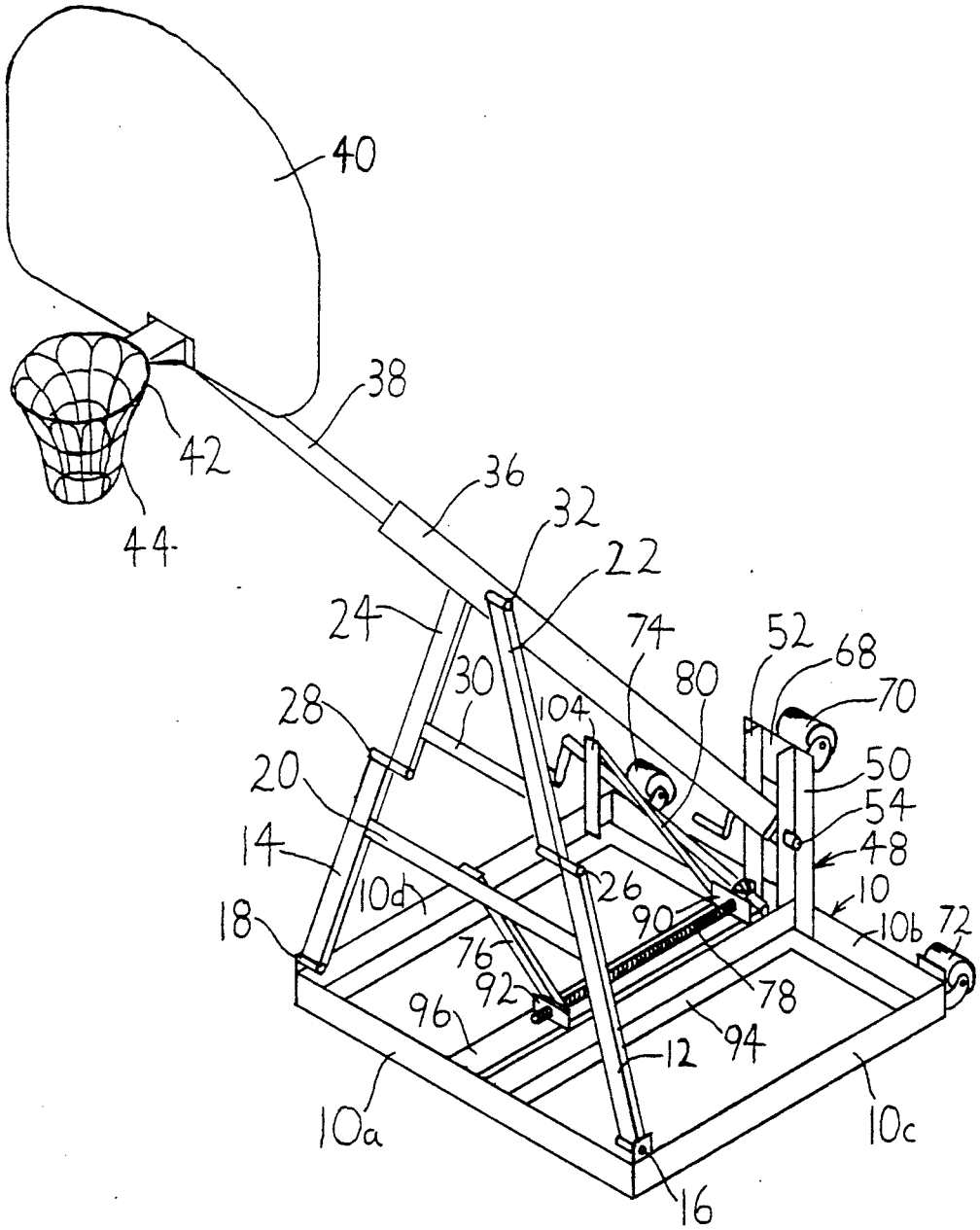
FIG. 1 is an isometric view of the preferred embodiment of the backboard assembly of the present invention, shown in its fully erected, upright position.
Figure 2:
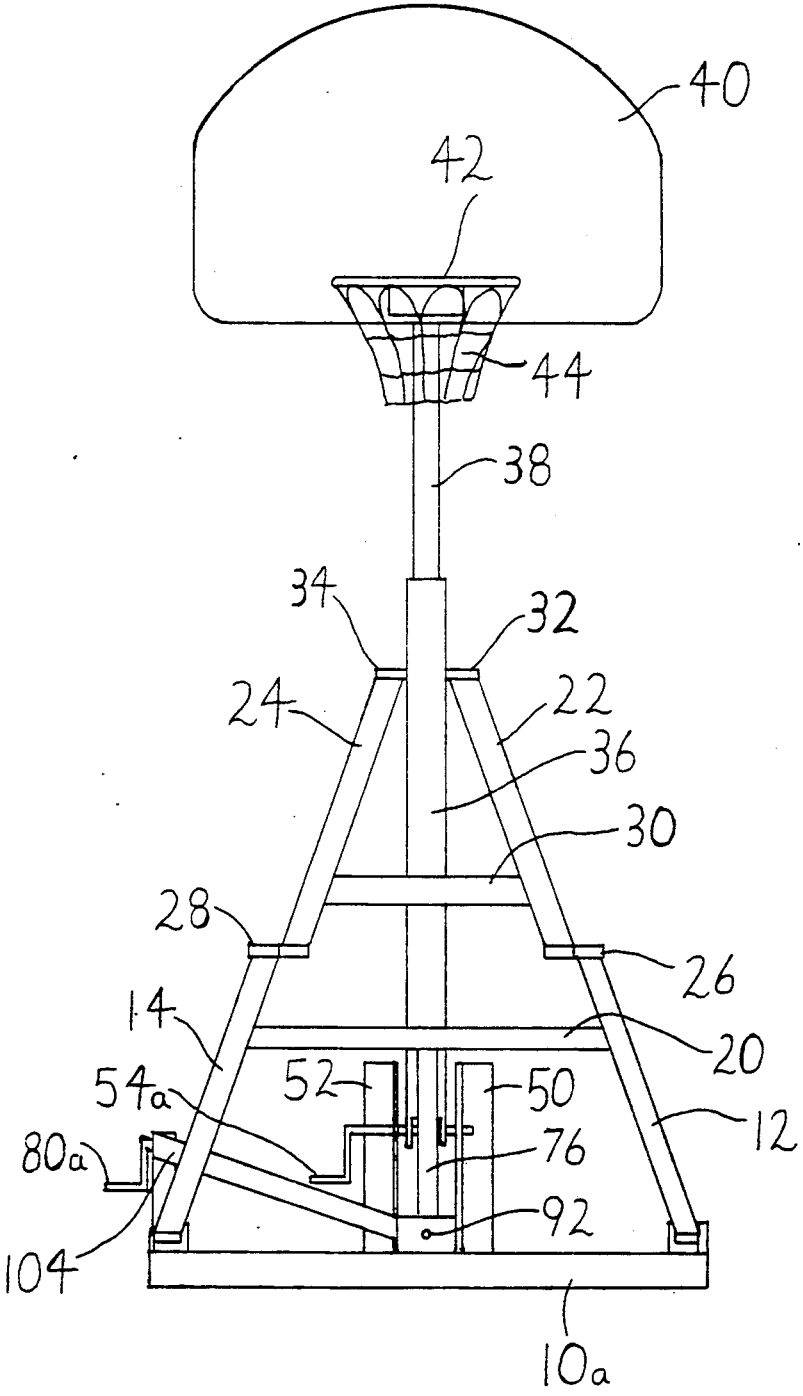
FIG. 2 is a front end view of the upright assembly shown in FIG. 1.
Figure 3:
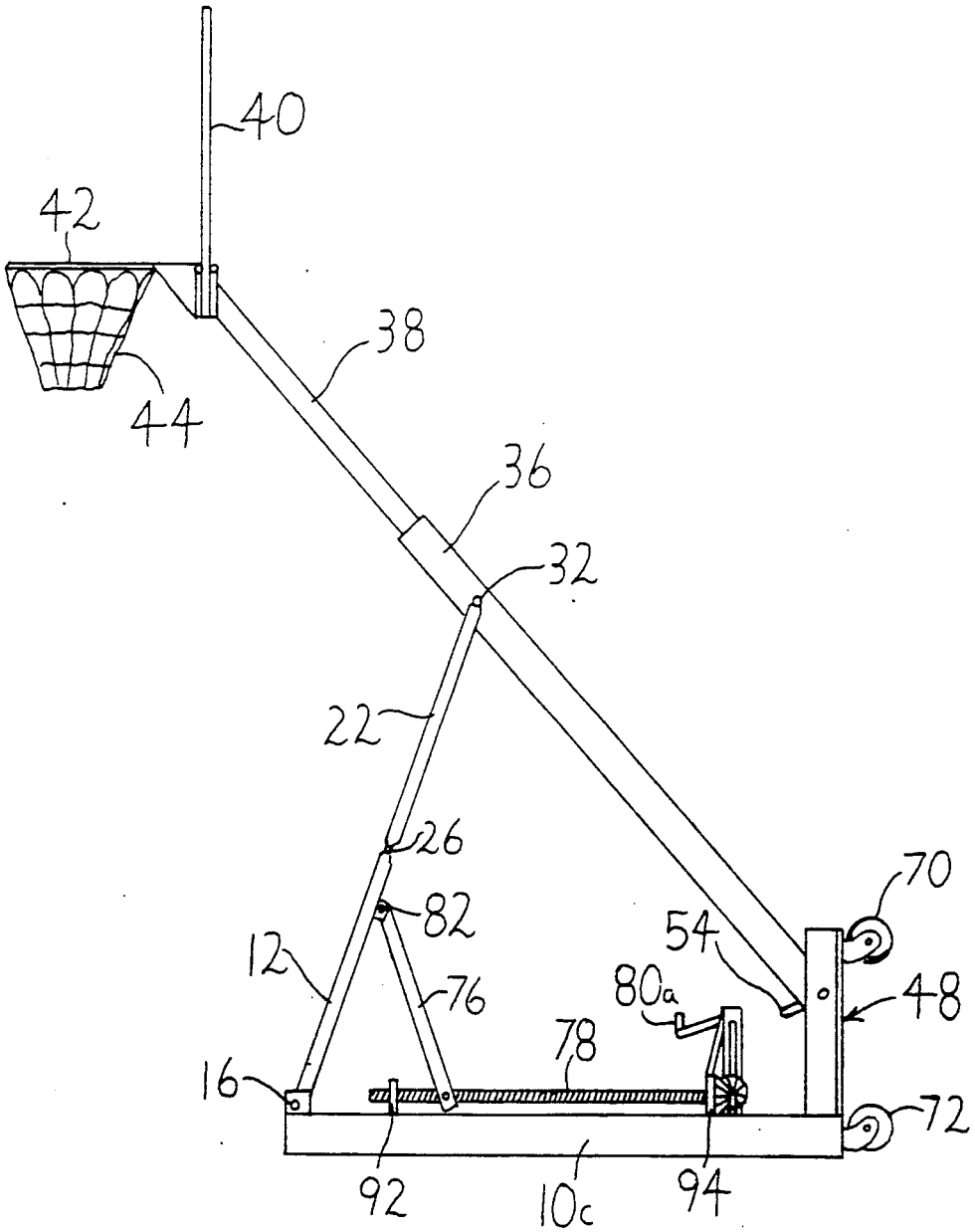
FIG. 3 is a side view of the upright assembly shown in FIG. 1.
Figure 4:
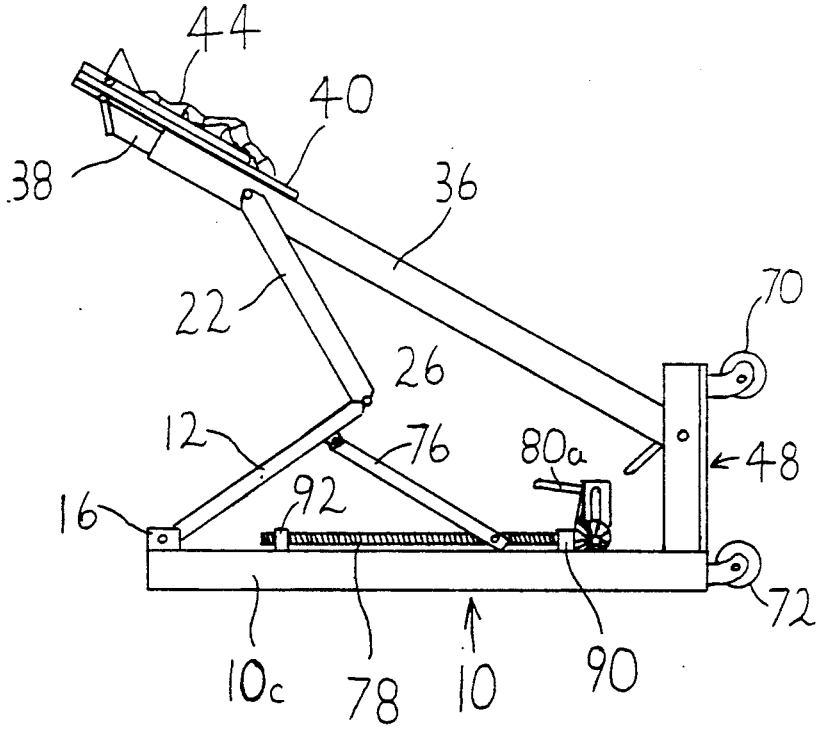
FIG. 4 is a side view as in FIG. 3 of the assembly of FIG. 1, with the assembly shown partially collapsed, in the process of being lowered (or raised)
Figure 8:
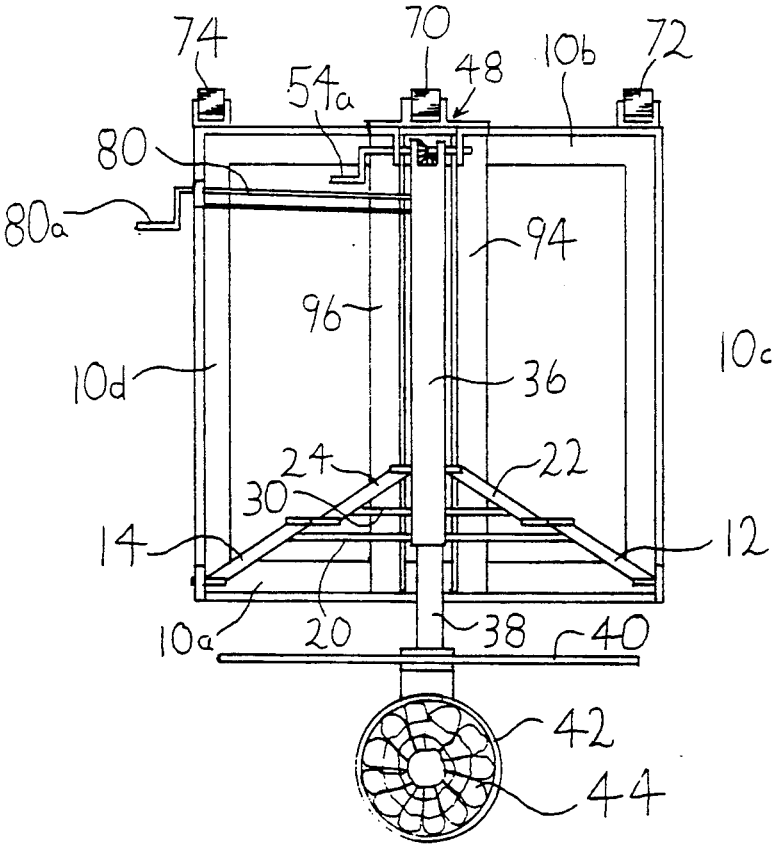
FIG. 8 is a top view of the erected backboard assembly of FIG. 1.

Referring first to the Figures, there is illustrated a preferred embodiment of the portable, foldable basketball backboard assembly of the present invention. The assembly is shown in an upright deployed position in FIGS. 1 through 3 and in FIG. 8, and is shown in a fully folded position in FIG. 5. FIG. 4 shows the assembly in an intermediate position, in between the fully folded and fully uprightpositions, as occurs when the assembly is being raised to the upright position or being lowered to the folded position. In the following description all references to orientations and directions are with respect to the assembly in the upright, or deployed position, as shown in FIGS. 1 through 3, except where specifically stated to be otherwise.

Referring first to FIGS. 1 through 3 and FIG. 8, the backboard assembly includes a planar, rectangular base 10 which rests flat on the ground or other playing surface when the assembly is in the upright, or deployed, position as illustrated. The base 10 as shown is formed of angle iron, although in other embodiments it may be formed of tubular steel or aluminum stock, or light weight polymeric stock. The base 10 includes a front edge member 10*a*, a rear edge member 10*b*, and parallel side members 10*c* and 10*d*. In the deployed position, the front edge member 10*a* is positioned adjacent to and facing the basketball court, and extends approximately along the boundary of the court.

A pair of lower support arms 12 and 14 extend upwardly and inwardly at an angle from the opposite ends of the front edge member 10*a* of the base 10. The lower ends of the lower support arms 12 and 14 are pivotably attached to the forward corners of the base 10 by means of pivot pin assemblies 16 and 18. The lower support arms 12 and 14 are braced by a fixed cross member 20. The upper ends of the lower support arms 12 and 14 are hinged to a pair of upper support arms 22 and 24, respectively by a pair of hinge pin assemblies 26 and 28, respectively. The upper support arms 22 and 24 are braced to one another by a fixed cross member 30.

The upper ends of the upper support arms 22 and 24 are pivotably connected by pivot pins 32 and 34, respectively, to a goal post extension tube 36, which is square in cross section. The pivot pins 32 and 34 extend transversely from opposite sides of the extension tube 36 at a point which is intermediate between the opposite ends of the tube 36, but which is closer to the upper end of the tube 36. The goal post extension tube 36 supports a telescoping goal post 38, which slides within the extension tube 36.

The goal post 38 supports a backboard 40, which in turn supports a basketball hoop 42 and associated basketball net 44.

Figure 9:
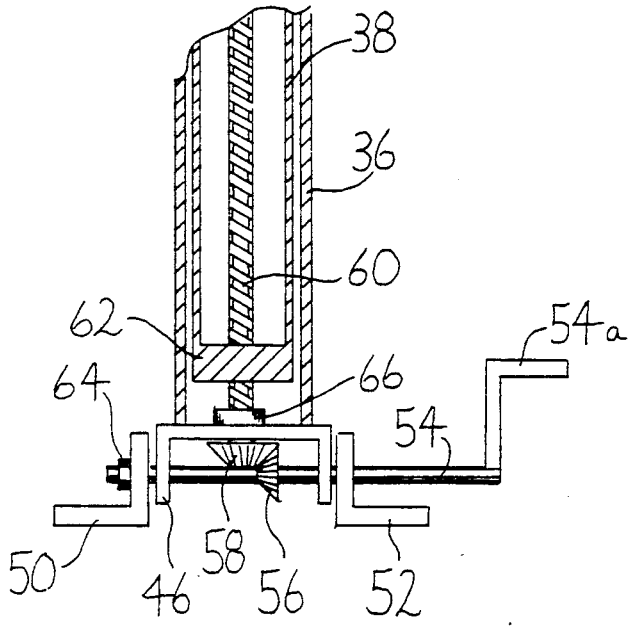
FIG. 9 is a detailed view of the telescoping goal post extension assembly.

The lower end of the goal post extension tube 36 is affixed to a yoke 46 (FIG. 9), which is pivotably attached to a short, upright support post 48. In the illustrated embodiment, the support post 48 consists of two upright angle irons 50 and 52, which extend upwardly from the rear edge member 10*b* of the base 10 when the backboard assembly is in the upright deployed position.

The yoke 46 is pivotably connected to the two angle irons 50 and 52 by a crankshaft 54 which serves two functions, as described below. The crankshaft 54 passes through coaxial bores in the ears of the yoke 46 and through coaxial bores in the two angle irons 50 and 52. The crankshaft 54 includes an integral handle 54*a*. The crankshaft 54 supports a spider gear 56, which is engaged with a cooperable spider gear 58 that is affixed to the end of a threaded extension shaft 60 that is contained within the extension tube 36. More particularly, the threaded extension shaft 60 passes through a threaded end cap 62 which is affixed to the interior end of the goal post 38. The threated extension shaft 60 also bases through a bore in the yoke 46, and terminates at the spider gear 58. Rotation of the crankshaft 54 and its spider gear 56 results in corresponding rotation of the spider gear 58 and the threaded extension shaft 62, thereby resulting in the telescoping goal post 38 being driven by the end cap 62 axially within the extension tube 36. The telescoping goal post 38 is extended from the extension tube 36 during deployment of the assembly into the upright position shown in FIG. 1, and is withdrawn into the extension tube 36 when the assembly is folded for storage. It will be noted that the goal post 38 and extension tube 36 extend at approximately a 45 degree angle, so that the backboard 40 and hoop 42 may be spaced outwardly from the base 10 and the other components of the assembly.

The crankshaft 54 is retained in position against axial displacement by a retaining ring 64 located outside the angle iron 50, and the spider gear 56, both of which are affixed to the crankshaft 54 by set screws or other appropriate means. The threaded extension shaft 60 is retained against axial displacement relative to the yoke 46 by means of a retaining ring 66, which is located on the opposite side of the yoke 46 from the spider gear 58.

The crankshaft 54 serves in a dual capacity as a crankshaft for the spider gear 56, and as a pivot pin for the extension tube 36 and its associated yoke 46, as described further below.

The two angle irons 50 and 52 constituting the support post 48 are connected at their upper ends by a bracing member 68, to which is mounted a rearwardly extending caster wheel 70. Two additional rearwardly extending caster wheels 72 and 74 are mounted to the opposite ends of the rear edge member 10*b* of the base 10. As described further below, the backboard assembly can be folded and tipped onto the caster wheels 70, 72 and 74, so as to enable the assembly to be moved and stored.

Figure 5:
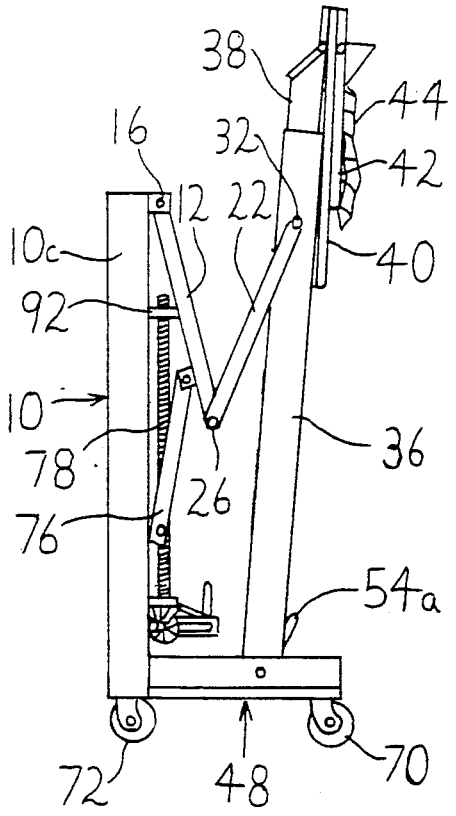
FIG. 5 is a side view of the assembly of FIG. 1, fully collapsed and tilted onto its wheels for transport.

In this regard, the extension tube 36 and the goal post 38 are movable between a raised, deployed position, as shown in FIGS. 1–3, and a lowered, folded position in which the assembly is tilted onto the caster wheels 70–74, as shown in FIG. 5. FIG. 4 shows an intermediate position, between the raised and lowered positions, in which the extension tube 36 and its goal post 38 are being raised upwardly or, alternatively, being lowered downwardly.

Figure 10:
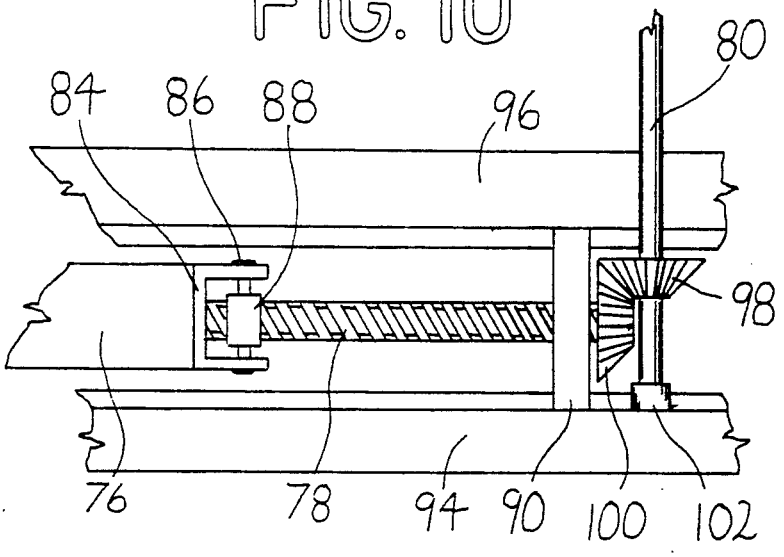
FIG. 10 is a detailed view of the lift arm erection mechanism of the backboard assembly.

Referring particularly to FIGS. 3, 4 and 10, the extension tube 36 and its goal post 38 are mechanically raised and lowered by a lift arm 76, which is driven by a threaded drive shaft 78 and an associated crankshaft 80. The lift arm 76 is pivotably connected at its upper end by a pivot pin 82 to the cross member 20 that braces the lower support arms 12 and 14. The lower end of the lift arm 76 is affixed to a yoke 84, which is pivotably attached by a pair of pivot pins 86 to a sliding threaded block 88 (FIG. 10), which is engaged with the threaded drive shaft 78. The drive shaft 78 is journalled at its opposite ends in a pair of bearing mounts 90 and 92, which are affixed to a pair of angle iron cross members 94 and 96 that extend between the front and rear edge members 10*a* and 10*b* of the base 10.

The drive shaft 78 is driven by the crankshaft 80 through a spider gear 98 affixed to the crankshaft 80, and a cooperably engaged spider gear 100 which is affixed to the end of the drive shaft 78. The crankshaft 80 is journalled at its lower end in a bearing 102 that is affixed to the cross member 94, and is journalled at its opposite end in an angular support 104, which functions to support the outer end of the crankshaft 80, including its integral handle 80*a*, at a level that is at a comfortable height for cranking.

The extension tube 36, together with the upper and lower support arms 12, 14, 22 and 24, are raised by cranking the crankshaft 80 so as to drive the lower end of the lift arm 76 outwardly along the drive shaft 78, as illustrated best in FIGS. 4 and 3. Likewise the extension tube 36 and its supporting arms are lowered by cranking the lift arm 76 rearwardly along the drive shaft 78.

In the fully raised position, shown in FIGS. 1 through 3, the lift arm 76 is driven outwardly almost to the end of the drive shaft 78, until the lower support arms 12 and 14 are aligned with the upper support arms 22 and 24.

In the fully lowered position, shown with the assembly tilted upwardly on the caster wheels in FIG. 5, the lift arm 76 is withdrawn to the inner end of the drive shaft 78.

A primary advantage of the lift mechanism just described is that the backboard assembly can be raised slowly and easily due to the mechanical advantage of the crankshaft/driveshaft combination, and yet is also prevented by the same mechanism from collapsing suddenly or unexpectedly. In this regard, the crankshaft 80 must be manually turned to lower the assembly gradually, thereby minimizing the possibility of injury or accident by sudden or unexpected lowering of the assembly.

It will be noted that the telescoping goal post 38 also must be extended and withdrawn by manual rotation of the crankshaft 54, thereby also preventing sudden withdrawal of the goal post 38 during disassembly. Also, the telescopic nature of the goal post 38 enables the backboard 40 to be set at various heights, ranging from regulation height to lower heights for accommodating children.

As illustrated, the caster wheels 70–74 extend rearwardly and out of the way when the assembly is deployed for use, but support the assembly for transport when it is collapsed and tilted onto the caster wheel assemblies.

Figure 6:
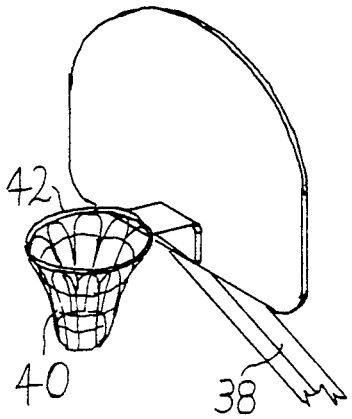
FIG. 6 is an isometric view of the backboard and hoop of the backboard assembly of FIG. 1.
Figure 7:
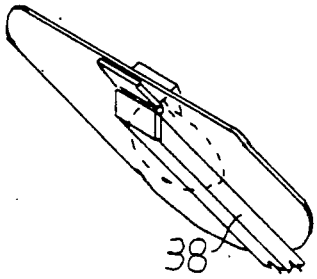
FIG. 7 is an isometric view of the backboard, folded in preparation for collapse and storage of the assembly.

The basketball hoop 42 is hinged to the backboard 40, and the backboard 40 is in turn hinged to the goal post 38, so that the backboard 40 and hoop 42 can be folded over and against the goal post 38 during disassembly, as shown in FIGS. 4, 6 and 7. This, together with the telescoping goal post, results in a compact, folded assembly that can be stored upright on the caster wheels 70–74 in a small area, for example in a small storage room, large closet or similar storage space.

Although the illustrated embodiment is shown as being constructed of angle iron components, it will be understood that the various structural components of the assembly may be made of iron or aluminum tubing or other conventional stock, or may be made of polymeric stock to render the assembly lighter and easier to deploy and transport.

The entire supporting structure may be covered with a suitable protective pad or other protective structure (not shown) when deployed for use, to reduce the likelihood of accidental injuries resulting from impact with the assembly. Further, the assembly may be anchored to the ground, or weighted in various manners, to increase its stability and rigidity.

It will be appreciated that the preferred embodiment described above is illustrative only and is described for the purpose of enabling one of ordinary skill in the art to make and use the invention. Various modifications, substitutions, and alterations may be apparent to one of ordinary skill in the art, and such may be made without departing from the essential spirit of the invention. Accordingly, the scope of the patent protection claimed herein is defined only by the following claims.

The embodiments of the invention in which patent protection is claimed are as follows:

1. A portable, foldable basketball backboard assembly comprising:

a base having front and rear ends;

at least one lower support arm having upper and lower ends, said lower end of said lower support arm being hinged to said front end of said base, at least one upper support arm having upper and lower ends, said lower end of said upper support arm being hinged to said upper end of said lower support arm, said upper end of said upper support arm being hinged to an intermediate point on an elongate goal post means, said goal post means having an upper end and a lower end, said goal post means supporting a basketball backboard and hoop at said upper end, said lower end of said goal post means being pivotably connected to said rear end of said base;

means for raising said upper and lower support arms upwardly into alignment so as to raise and support said goal post means and said basketball backboard and hoop at a height suitable for playing basketball; and said assembly including a plurality of rearwardly extending caster wheel assemblies, onto which the assembly may be tipped with said goal post means lowered into a lowered position, for transport and storage of said assembly.

2. The portable, foldable basketball backboard assembly defined in claim 1 wherein said assembly comprises first and second pairs of said upper support arms and said lower support arms, and wherein said lower ends of said lower support arms are hinged to opposite sides of said front end of said base.

3. The portable, foldable basketball backboard assembly defined in claim 1 further comprising an upright support post that extends upwardly from said rear end of said base, and wherein said lower end of said goal post means is hinged to said support post.

4. The portable, foldable basketball backboard assembly defined in claim 3 wherein said goal post means comprises a tubular extension tube hinged to said upright support post, and a telescoping goal post slidably contained within and extending from said extension tube, and extension means for selectively extending said goal post from or withdrawing said goal post into said extension tube.

5. The portable, foldable basketball backboard assembly defined in claim 4 wherein said extension means comprises a threaded shaft contained within said extension tube, said goal post including a threaded end cap engaged with said threaded shaft, and crankshaft means for selectively turning said threaded shaft for extending or withdrawing said goal post.

6. The portable, foldable basketball backboard assembly defined in claim 5 wherein said crankshaft means comprises a crankshaft operably connected to said threaded shaft by a pair of spider gears affixed to said crankshaft and to said threaded shaft, respectively, and wherein said crankshaft is journalled in said upright support post.

7. The portable, foldable basketball backboard assembly defined in claim 6 wherein said tubular extension tube is hinged to said upright support post by said crankshaft.

8. The portable, foldable basketball backboard assembly defined in claim 7 wherein there is affixed to an upper end of said upright support post a first rearwardly extending caster wheel, and wherein second and third rearwardly extending caster wheels are affixed to opposite sides of said rear end of said base, whereby said assembly may be tilted upwardly onto said caster wheels for transport and storage.

9. The portable, foldable basketball backboard assembly defined in claim 8 wherein said basketball backboard is hinged to said goal post and said basketball hoop is hinged to said backboard, whereby said hoop and said backboard may be folded backward over said goal post upon folding of said assembly for storage.

10. The portable, foldable basketball backboard assembly defined in claim 3 wherein said means for raising said upper and lower support arms upwardly into alignment comprises a lift arm, a threaded drive shaft journalled to said base and extending rearwardly from and beneath said lower support arms, and a crankshaft, said lift arm having an upper end hinged to said lower support arms, and said lift arm having a lower end hinged to a threaded drive block engaged with said drive shaft, said crankshaft being operably engaged with said drive shaft, whereby rotation of said crankshaft results in rotation of said drive shaft so as to drive said lower end of said lift arm along said drive shaft, thereby raising or lowering said lower support arms and said goal post means.

11. The portable, foldable basketball backboard assembly defined in claim 10 wherein said upper end of said lift arm is hinged to a cross member connecting said lower support arms.

12. The portable, foldable basketball backboard assembly defined in claim 10 wherein said threaded drive shaft is journalled to a cross member extending between said front and rear ends of said base.

13. The portable, foldable basketball backboard assembly defined in claim 12 wherein said crankshaft is connected to said threaded drive shaft by a pair of spider gears affixed respectively to said crankshaft and said threaded drive shaft.

14. The portable, foldable basketball backboard assembly defined in claim 13 wherein said crankshaft is journalled and supported by an angular support which raises the outer end of said crankshaft.

15. The portable, foldable basketball backboard assembly defined in claim 10 wherein said goal post means comprises a tubular extension tube hinged to said upright support post, and a telescoping goal post slidably contained within and extending from said extension tube, and extension means for selectively extending said goal post from or withdrawing said goal post into said extension tube.

16. The portable, foldable basketball backboard assembly defined in claim 15 wherein said extension means comprises a threaded shaft contained within said extension tube, said goal post including a threaded end cap engaged with said threaded shaft, and crankshaft means for selectively turning said threaded shaft for extending or withdrawing said goal post.

17. The portable, foldable basketball backboard assembly defined in claim 16 wherein there is affixed to an upper end of said upright support post a first rearwardly extending caster wheel, and wherein second and third rearwardly extending caster wheels are affixed to opposite sides of said rear end of said base, whereby said assembly may be tilted upwardly onto said caster wheels for transport and storage.

18. A portable, foldable basketball backboard assembly comprising:

a base having front and rear ends;

at least one lower support arm having upper and lower ends, said lower end of said lower support arm being hinged to said front end of said base, at least one upper support arm having upper and lower ends, said lower end of said upper support arm being hinged to said upper end of said lower support arm;

an elongate extendible goal post, said upper end of said upper support arm being hinged to an intermediate point on said elongate extendible goal post, said goal post having an upper end and a lower end, said goal post supporting a basketball backboard and hoop at said upper end, said lower end of said goal post being pivotably connected to said rear end of said base, and said goal post being extendible between a retracted position and an extended position; and means for raising said upper and lower support arms upwardly so as to raise and support said extendible goal post and said basketball backboard and hoop at a height suitable for playing basketball.

19. The portable, foldable basketball backboard assembly defined in claim 18 wherein said means for raising said upper and lower support arms upwardly comprises a lift arm having upper and lower ends, said upper end of said lift arm being pivotably connected to said lower support arm, said lower end of said lift arm being engaged with a threaded drive shaft journalled to said base and extending rearwardly from said lower support arm, and means for rotating said threaded drive shaft, whereby rotation of said drive shaft drives said lower end of said lift arm rearwardly or forwardly with respect to said base, to thereby raise or lower said support arms and said goal post.

* * * * *